US009049949B1

(12) United States Patent
Taylor

(10) Patent No.: US 9,049,949 B1
(45) Date of Patent: Jun. 9, 2015

(54) DRINK CONTAINER LID DISPENSER

(76) Inventor: James M. Taylor, Reddick, FL (US)

( * ) Notice: Subject to any disclaimer, the term of this patent is extended or adjusted under 35 U.S.C. 154(b) by 664 days.

(21) Appl. No.: 13/102,097

(22) Filed: May 6, 2011

(51) Int. Cl.
*B65G 59/06* (2006.01)
*B65D 83/00* (2006.01)
*A47F 1/08* (2006.01)

(52) U.S. Cl.
CPC ..... *A47F 1/085* (2013.01)

(58) Field of Classification Search
USPC ..... 221/191, 194, 195, 208, 210, 221, 222, 221/223, 224, 255, 268
See application file for complete search history.

(56) References Cited

U.S. PATENT DOCUMENTS

| | | | | |
|---|---|---|---|---|
| 1,330,639 | A * | 2/1920 | Leumann | 221/298 |
| 1,590,926 | A * | 6/1926 | Cooley | 221/40 |
| 1,657,879 | A * | 1/1928 | Carle | 221/40 |
| 2,445,958 | A * | 7/1948 | Lindstrom | 221/223 |
| 4,436,222 | A * | 3/1984 | Taylor et al. | 221/223 |
| 6,474,503 | B2 * | 11/2002 | Davis | 221/223 |
| 8,272,533 | B1 * | 9/2012 | D'Amelia et al. | 221/197 |
| 2004/0084472 | A1 * | 5/2004 | Thompson | 221/232 |

* cited by examiner

*Primary Examiner* — Gene Crawford
*Assistant Examiner* — Kelvin L Randall, Jr.
(74) *Attorney, Agent, or Firm* — Sven W. Hanson

(57) ABSTRACT

A dispensing device and method is provided for separating individual food or drink container lids from a multiple-lid stack for use. The device supports a vertical stack of nested lids and allows a single bottom-most lid to fall away from the remaining lids in the stack. The device may be incorporated in a stand-alone dispenser for consumer use or be incorporated into existing or other incidental structures such as fast food restaurant countertops.

1 Claim, 7 Drawing Sheets

DRINK CONTAINER LID DISPENSER

BACKGROUND OF THE INVENTION

The present invention pertains to devices and methods of dispensing food container lids. Particularly within what is termed the "fast food" industry, foods and more particularly drinks, are typically sold in disposable containers for which lids are provided for the convenience of the buyer. These lids are typically very thin and light weight and sold and distributed to food vendors in stacks of many multiple lids. Dispensing individual lids to food buyers is problematic and no practical lid dispenser is yet available. The most common practice is to make accessible to the food buyer a quality of loose or stacked lids so that the buyer may manually select a lid for their use. In this process many lids may be handled by the buyer in their efforts. This creates a health risk to subsequent buyers who may use the remaining lids.

To resolve this problem, many different lids dispensers have been proposed in the prior art. Unfortunately, a simple and reliable lid dispenser is not yet available to the market. One problem that has been difficult to overcome is the inherent nesting of lids arranged in a stack. This nesting, combined with the high flexibility of the individual lid, makes separation of individual lids difficult. Dispensing devices that apply significant force to the lids often result in bending and distortion of the lids and result in adjacent lids sticking together. What is needed is a simple lid dispensing device that reliably separates individual lids from lid stacks.

SUMMARY OF THE INVENTION

The present invention is a device and method of separating individual lids from a vertical stack of nested lids.

In operation of the inventive devices, a vertical stack of lids is supported on multiple upward facing support surfaces. A number of separators are positioned between the two bottom-most lids in the stack without applying substantial force being applied to any of the lids. Gripping devices are arranged about the vertical sides of the lid stack and are used to support the stack during a dispensing operation. While the stack is supported by the gripping devices, the support surfaces are moved downward and away from the stack in a manner to allow the single bottom-most lid to separate and fall from the remaining lids in the stack. No substantial force is applied to the lids that may flex or distort the lid. Various different devices may optionally be used to guide the separated lid to the user. Preferably, a controller is provided to allow a user to operate the dispenser with a simple and single motion without handling any lids.

In a preferred embodiment, a dispenser includes a vertical container or chute to receive a replaceable stack of lids. Two sets of operators are arranged on opposing sides of the container and stack. Each set of operators controls respective support surfaces and gripping devices and separators. The two sets of operators are coordinated to operate at the same time by a common joined operating handle. The devices operate through a single dispensing motion of the handle which then may return to its starting condition to allow repeated dispensing. This embodiment may take the form of a stand-alone dispensing device. Alternatively, the mechanisms of the device may be incorporated into a food service facility such as a food counter and include a user operated switch or actuator that may be separated from the other elements of the device.

Additional novel aspects and benefits of the invention will be discerned from the following description of particular embodiments and the accompanying figures.

DETAILED DESCRIPTION OF EMBODIMENTS OF THE INVENTION

Figure 1:
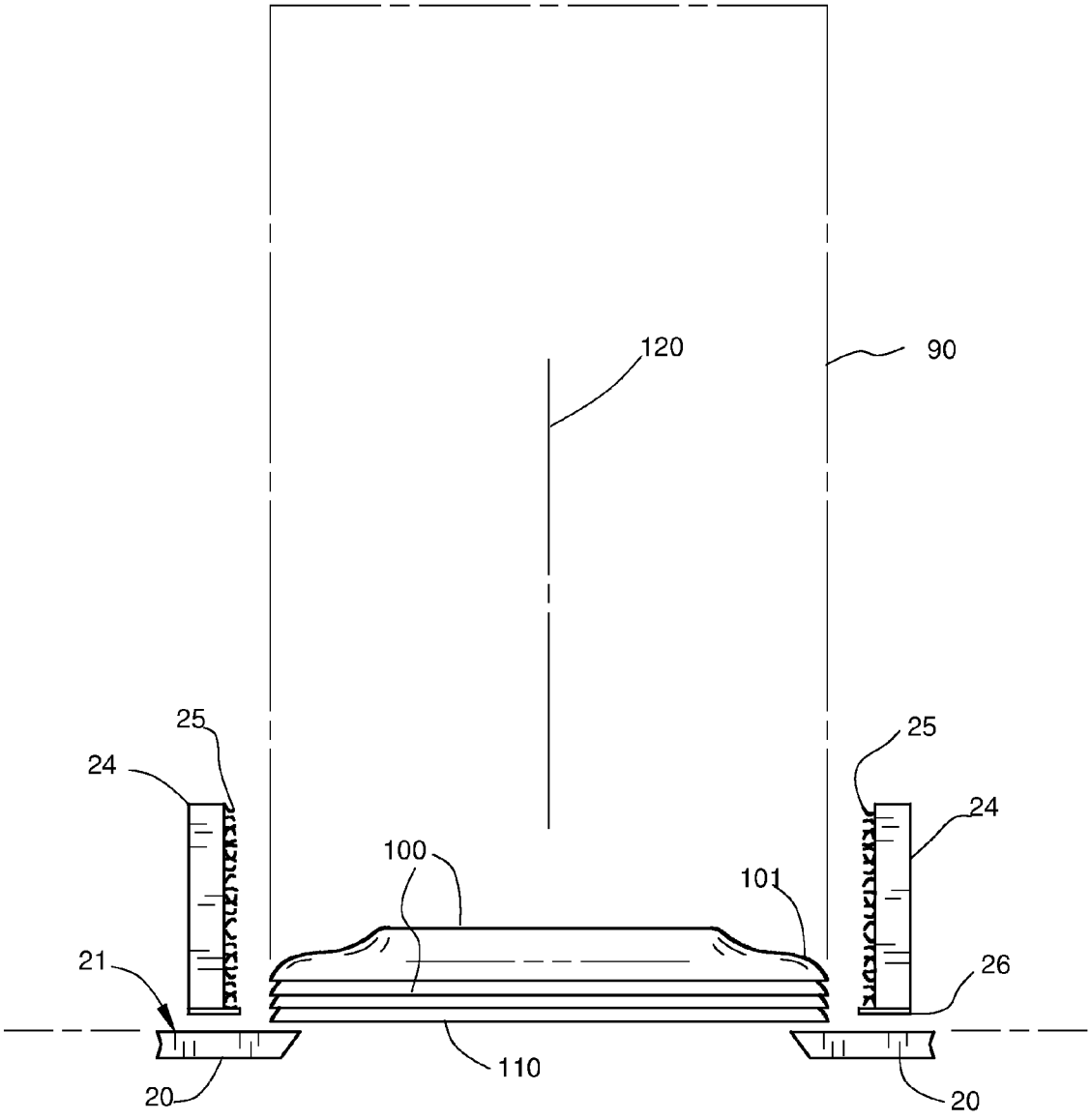
FIGS. 1, 2*a*, 2*b* and 3 depict in side view a stack of multiple conventional drink container lids and details of operable elements in various conditions of operation of the present invention.

FIGS. 1, 2*a*, 2*b* and 3 illustrate one configuration of operable elements that accomplish the separation and dispensing of consecutive individual lids from a stack of conventional drink lids according to the invention. Essential operations and elements of the invention are below described with respect to these illustrations. Details of complete dispenser configurations including the similar operations and elements of FIG. 1, 2*a*, 2*b*, 3 are provided in subsequent figures and discussion.

Herein, the term "lid" means any of a variety of similarly constructed articles used to close the upper open end of a conventional drink container, or similar food container. Such lids are typically formed of a plastic or synthetic resin material and have a substantially circular top wall and a downwardly extending peripheral skirt. The term "downward", and associated forms of the word, as used throughout this specification and claims with reference to lids, refers to the relative orientation and position of the lid skirt with respect to the lid, when the lid is placed over the upwardly facing open end of a drink container in normal fashion. Otherwise, such directional or orientation terms are intended to be relative to the respective elements and are not limiting on the invention. The length of a lid skirt may vary, and the present invention has been found to successfully operate with lids of a great variety of skirt lengths and geometries. A conventional lid may also have other incidental features including elements designed to help capture the open end of a drink container against the skirt. The present invention is not limited by the size or geometry of the lid and is generally useful for dispensing conventional lids.

FIGS. 1, 2*a*, 2*b* and 3 depict a lid stack 90, in schematic form for clarity, and several individual lids 100 of the stack 90. The lids 100 are all arranged in a vertical stacked formation with a common vertical centerline so that they, at least partially, "nest", one within the next above. Each lid 100 has a skirt portion 101 that extends generally downwardly to a perimeter edge 102. In this way, such a stack as shown is termed a "downward facing" stack.

For cost and other requirements, drink container lids in the industry are typically very thin and light weight. Due to their inevitably highly flexible construction, individual lids and stacks of lids are easily deformed when grasped or held. This deformation often results in adjacent nested lids binding or jamming together and is believed to be a major source of the difficulty found in prior art in separating and dispensing individual lids. In the present invention, a lid stack is retained by using a minimum of external force to eliminate this problem.

In the assembly shown, the lid stack 90 is supported on four supports 20 in a support condition. Only two of the four supports are visible in FIG. 1 (see also FIG. 4). The stack 90 is resting by only gravity on a horizontal and planar upward facing supporting surface 21 of the supports 20 that are placed symmetrically around the stack 90 and immediately below the bottom lid skirt 101. All the supporting surfaces are on a common plane so that the lids are supported without bending. For clarity, the supports 20 are illustrated as slightly separated from the stack 90, but in fact no separation exists and the bottommost of the lids 100 contacts the supports 20. The lids 100 in the stack 90 are not forced down or otherwise crushed or held against the supports 20 and any such attempted forcing or loading is contrary to the invention as inhibiting separation of individual lids.

Two grippers 24 are aligned on diametrically opposing sides of the stack 90. The grippers 24 each include a grip face 25 oriented vertically and parallel to the vertical axis and stack face (the perimeter edge 102 of the combined lids effectively make up the stack face). Most preferably, the grip face 25 is formed of one side of a "hook-and-loop" fastening fabric, such as those distributed under the brand "Velcro"™. The function of the grip face 25 is to secure the stack 90 from vertical and lateral movement. This is accomplished by using sufficient force to engage the grip face 25 with at least the several bottom-most, but one, lids of the stack 90, while limiting this force below that capable of deforming the stack 90. No substantial force is exerted to the stack, only enough to engage the grip face material with the edge 102. In this manner, it is the vertical interference between the bodies that supports the stack 90. In the embodiment shown, the extended "hook" elements of grip face 25 can be pushed past and between, below and above, each lid perimeter edge 102, where they can support the lids vertically. This is accomplished with minimal force, and with essentially no force against the perimeter edge 102.

The grip face 25 may be formed of any of a variety of alternative materials or constructions that likewise allow gripping of the stack 90 with a force less than the force that might deform the lids captured between the two grippers. For example, but not limited to, very soft sponge rubber, or constructions using flexible small horizontal appendages may be used.

Each gripper 24 has a grip face vertical dimension, parallel to the stack axis, tall enough to allow the gripper 24 to engage as least enough lids 100 in the stack 90 such that they can, together with the grip ledge 26 (see FIG. 2*b*), support the stack 90 and stabilize the stack 90 laterally. The entire stack 90 need not be held or engaged. It is suggested that the grip face vertical dimension be about 1.85 inches. It is also suggested that in use, the stack of lids is retained at a height at least equal to the vertical dimension. The suggested or preferred dimensions provided herein presume use with food container lids of any conventional diameter.

Figure 2A:
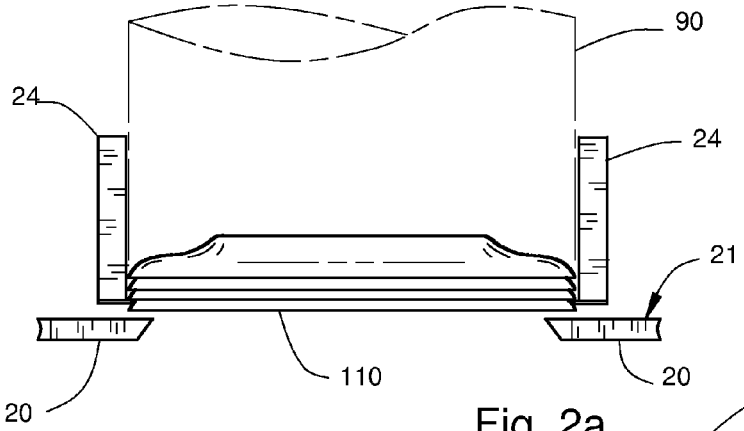
Figure 2B:
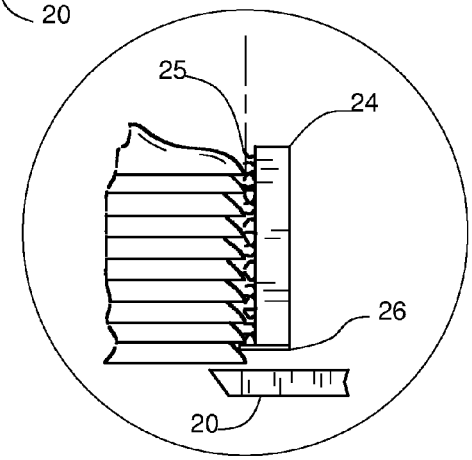
Figure 3:
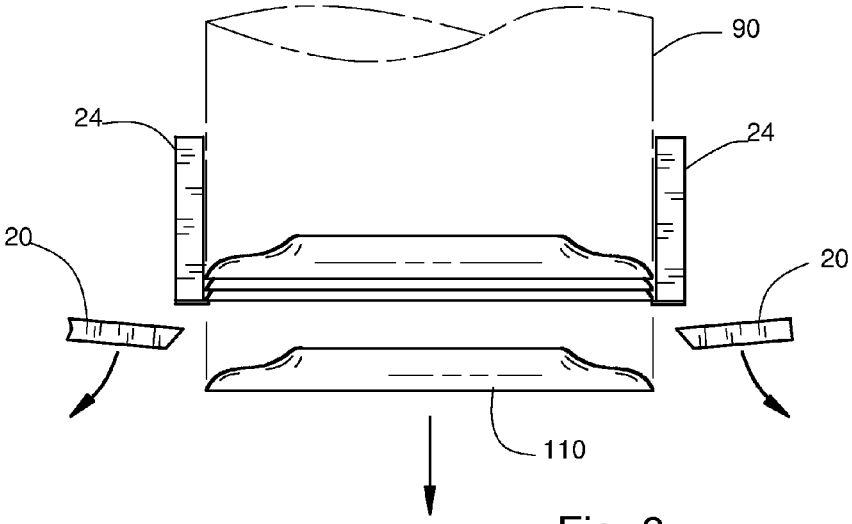

In FIG. 1, in operation the grippers 24 are initially separated from the stack 90 as would be the case before a lid is to be dispensed. In FIG. 2*a*, during the beginning of a dispensing action, the grippers 24 are both moved inward to engage their respective grip faces with the stack 90. In FIGS. 2*a* and 3, the details of the grip faces 25 are not included for clarity, due to their relatively small dimension. FIG. 2*b* illustrates the gripper elements and their engagement with a lid stack in more detail. In FIGS. 2*a*, 2*b* and 3, the stack 90 is truncated in view for simplicity.

As shown in FIG. 2*b*, at the bottom of each gripper 24, a projecting gripper ledge 26 extends outward towards the stack 90 and toward the stack 90. The ledge 26 is sized, positioned, and oriented such that when the grippers 24 are moved inward to engage with the stack 90, during the dispensing action, the ledge 26 is interposed between the bottom lid 110 in the stack 90 and the adjacent lid (above the bottom lid). The ledge 26 must not be biased or forced against any lid such as to cause deformation of a lid. Because the spacing between different lid designs may be different, it is suggested that the ledge 26 be positioned above the perimeter edge of the bottom lid 110 an offset height dimension of approximately 1/32 inch (0.0312 inch), above the perimeter edge of the bottom lid 110 as this dimension has been found to successfully separate the great majority of typical lid geometries currently used. This is also the vertical distance of the ledge 26 above the support face 21. The gripper ledges 26, together function as a separator to separate the bottom lid 110 from the remaining lids in the stack 90. However, the word "separate" should not be construed as implying a force applied to the dispensed lid, as no force is applied to the dispensed lid and application of any such force may instead defeat the operation of the inventive device. Rather, the word here means to provide a barrier between to promote relative movement.

The horizontal length LL of projection of the ledge 26 from the face of the gripper 24 should be only enough to engage the perimeter of the lid adjacent (above) the bottom lid 110 and should not impinge on the lids such as to bend or disrupt them. A suggested length for LL is about 0.14 inch. This dimension ensures that the particular geometry of the lids is not a factor in operation of the device and prior knowledge of the geometry (other than diameter) need not be obtained. In this way, the inventive device is operable with any of a variety or range of lid geometries or a stack containing a mixture of geometries. Lid "geometry" here is intended to include the lid thickness, height, and shape between the perimeter and centerline axis. Because lid geometry is known to vary considerable among currently used lids, unless a dispensing device functions independent of lid geometry, it must be specifically designed for a lid geometry and may not be interchangable with other lids. This is a significant advantage of the present design. The ledge 26 is preferably rigid but requires little stiffness or strength to carry out its function. Preferably both the gripper 24 and ledge 26 have a width dimension (perpendicular to the stack radius) of about 0.36 inches wide, although this dimension is not critical and a wider element will be effective.

Because the stack 90 is essentially free standing and undeformed, when the supports 20 are moved away from the stack, as shown in FIG. 3 (illustrated by movement arrows) the bottom lid 110 is free to fall away from the stack 90. The bottom lid 110 may then be directed to a location separated from the stack for easy handling and use. To facilitate the release of the bottom lid 110, the supports 20 are moved quickly away in a curved or circular path. This minimizes the potential of frictional forces between the supports 20 and the bottom lid 110 disrupting the release of the lid.

Although not shown in the figures, in a subsequent operations the supports 20 are allowed to return to their support condition as seen in Figure. The curved or circular path of the supports 20 is essential in this operation to return the supports to the support condition without disturbing or moving the lid stack 90 and, in particular, the new bottom lid. On the return motion, the supports 20 approach the lid stack 90 in a combined rising and inward motion. Once the supports 20 are returned to their original position, the grippers 24 are moved away from the stack 90 so that the stack 90 falls to be supported again by the supports 20 as in FIG. 1. The dispensing action described above may be repeated in like manner to dispense additional lids 100 from the stack 90.

Figure 4:
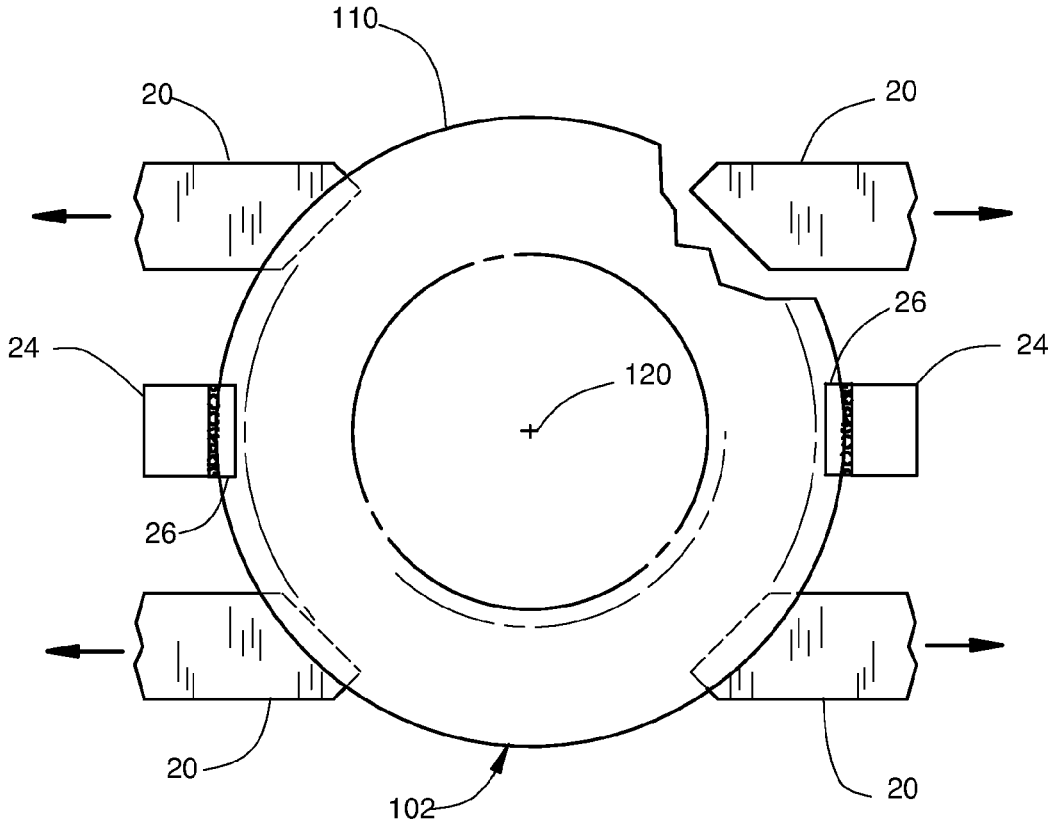
FIG. 4 is a plan view of details of operable elements of the invention and their relation to a stack of drink container lids.

FIG. 4 depicts in plan view the same elements and configuration as shown in FIG. 2*a*. Four supports 20 are arranged in symmetric pattern about a vertical axis 120 that is colinear with the center longitudinal axis of the stack 90. The symmetry is important to ensure no distortion of the lids due to the weight of the stack. However, a perfect axi-symmetric pattern is not necessary, only sufficient symmetry to prevent unbalanced bending forces on the lids and stack. Only the bottom lid 110 is illustrated (the remaining lids 100 in the stack are hidden for clarity). The ledge 26 can be seen to overlap over the perimeter of the bottom lid 110. In this view, the curved or circular aspect of the support motion is not perceptible as the motion in this configuration is in a vertical plane. The spacing between the supports 20 is determined by the diameter of the lids to be dispensed.

Figure 5:
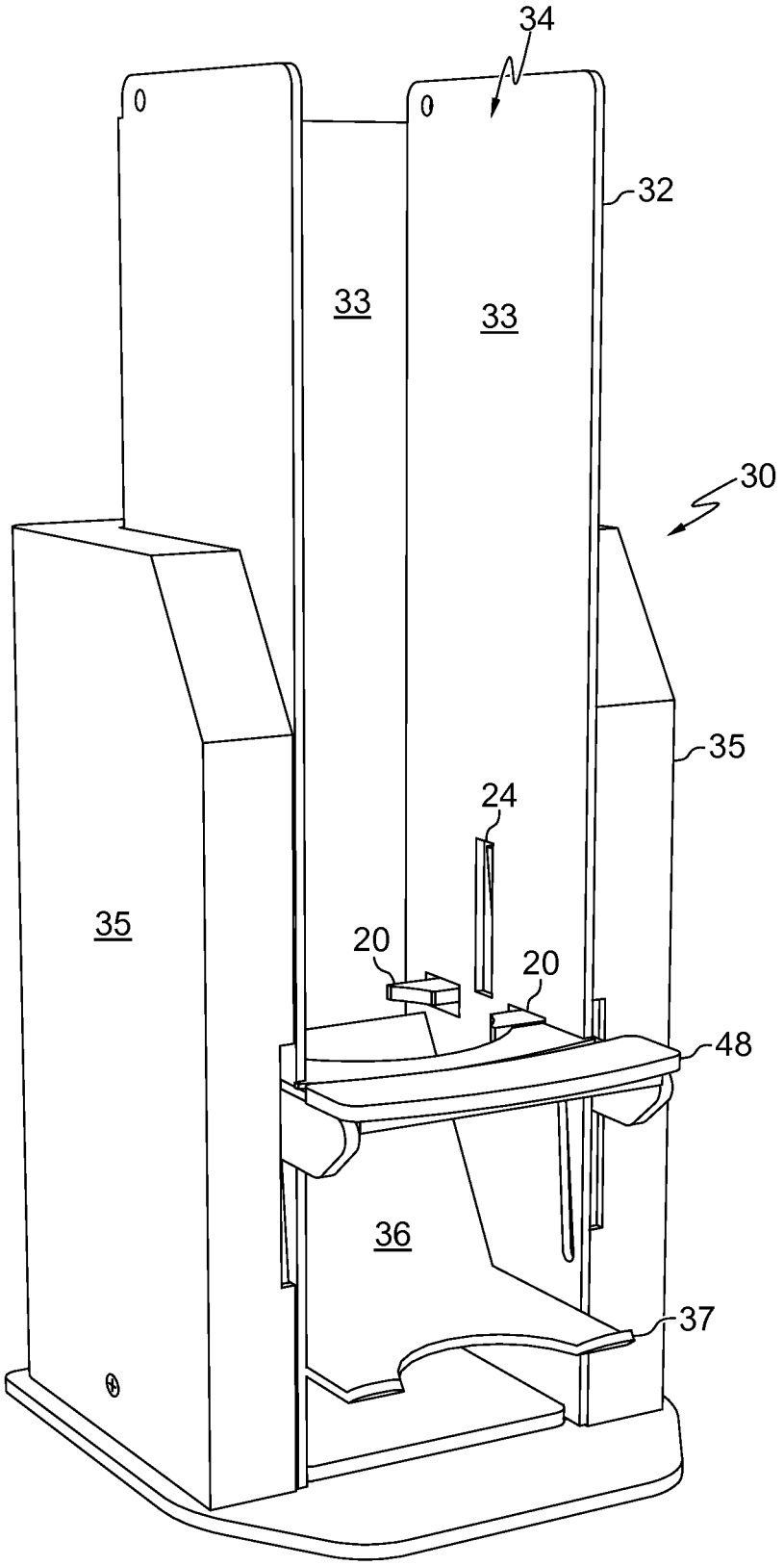
FIG. 5 is a perspective view of a preferred embodiment of the drink container lid dispenser according to the invention.
Figure 6A:
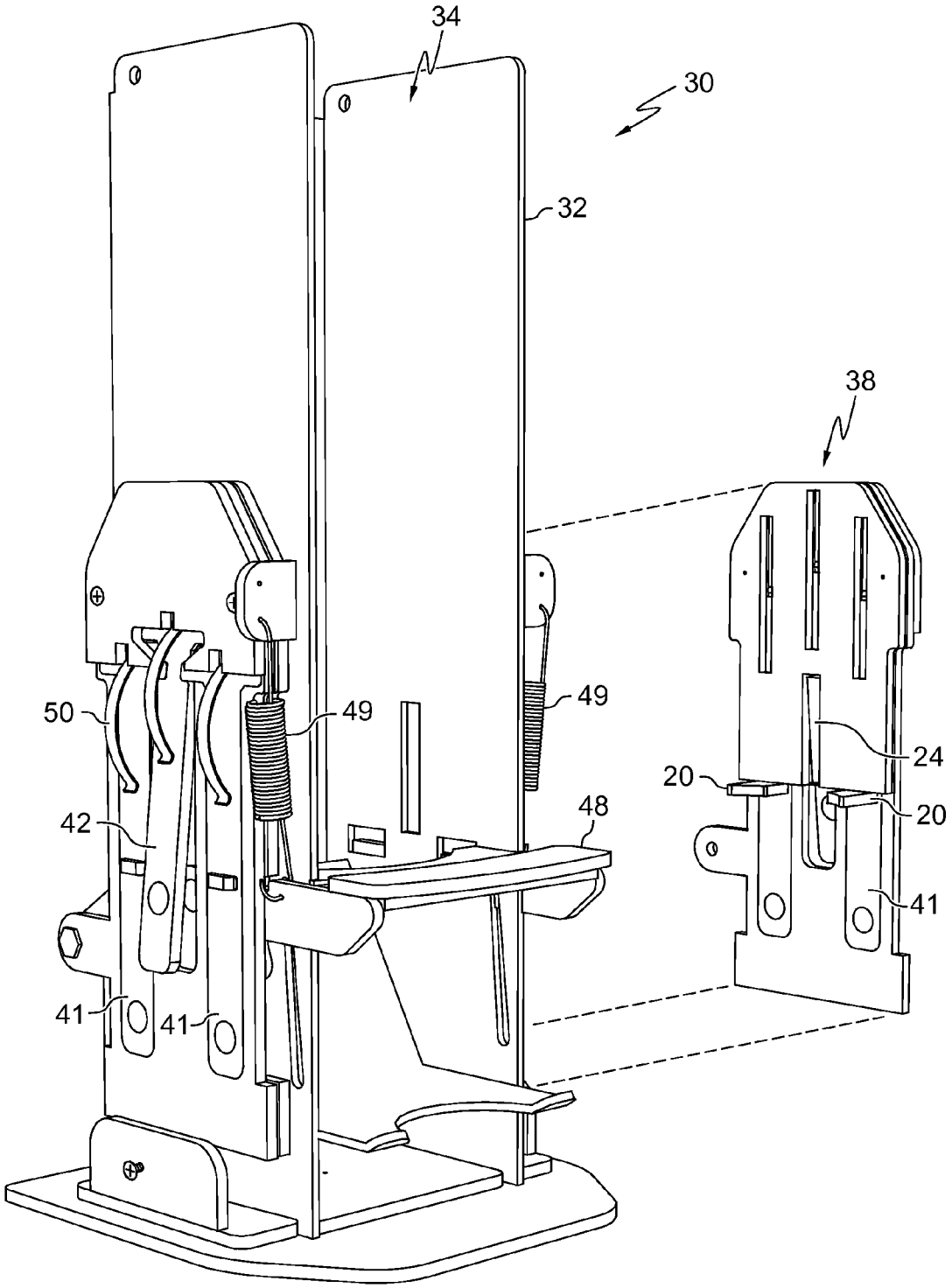
FIG. 6*a* is a perspective view of the device in FIG. 5 with the lid dispensing mechanism exposed and in condition to dispense a drink container lid.
Figure 6B:
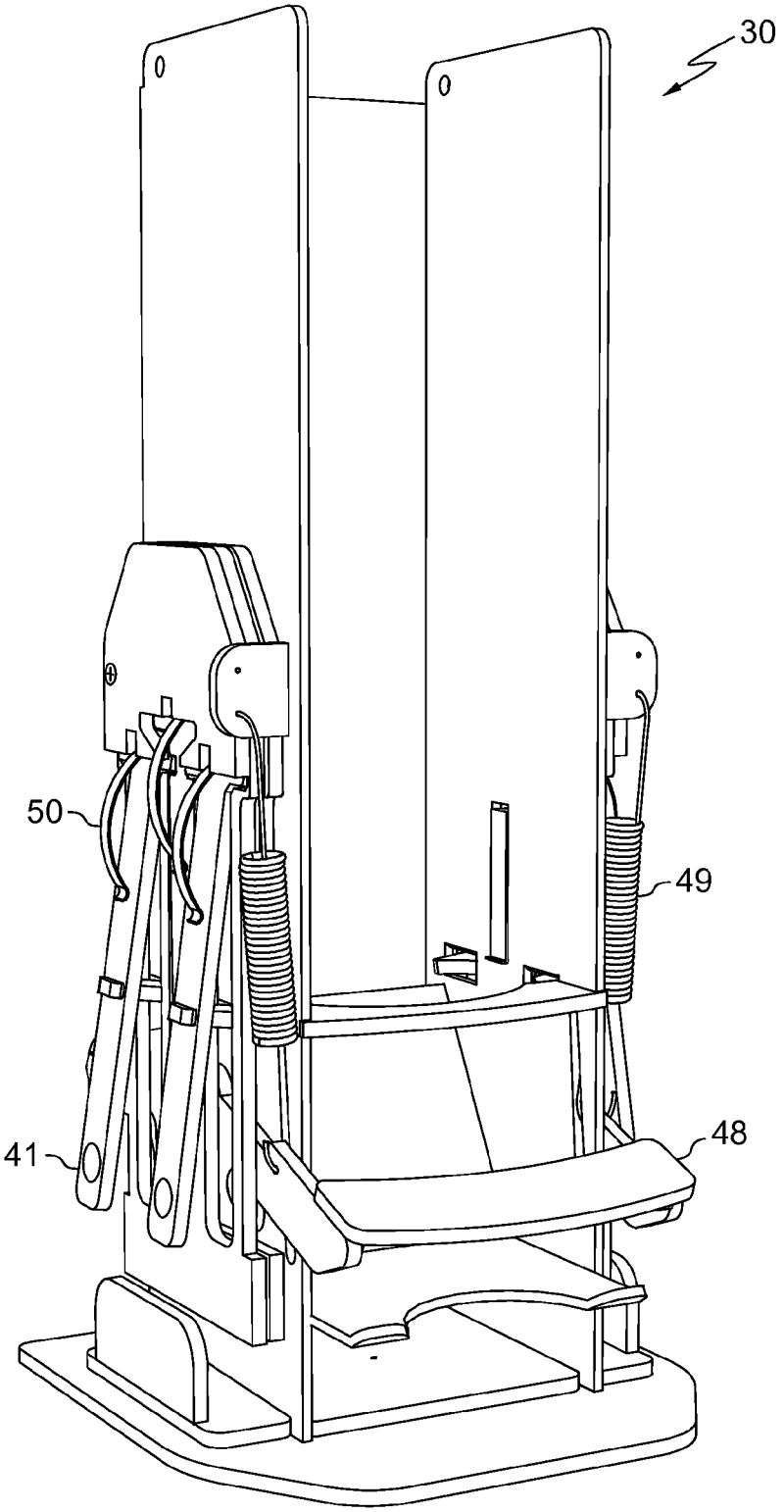
FIG. 6*b* is a perspective view of the device in FIG. 5 with the lid dispensing mechanism exposed and actuated to dispense a drink container lid.
Figure 7:
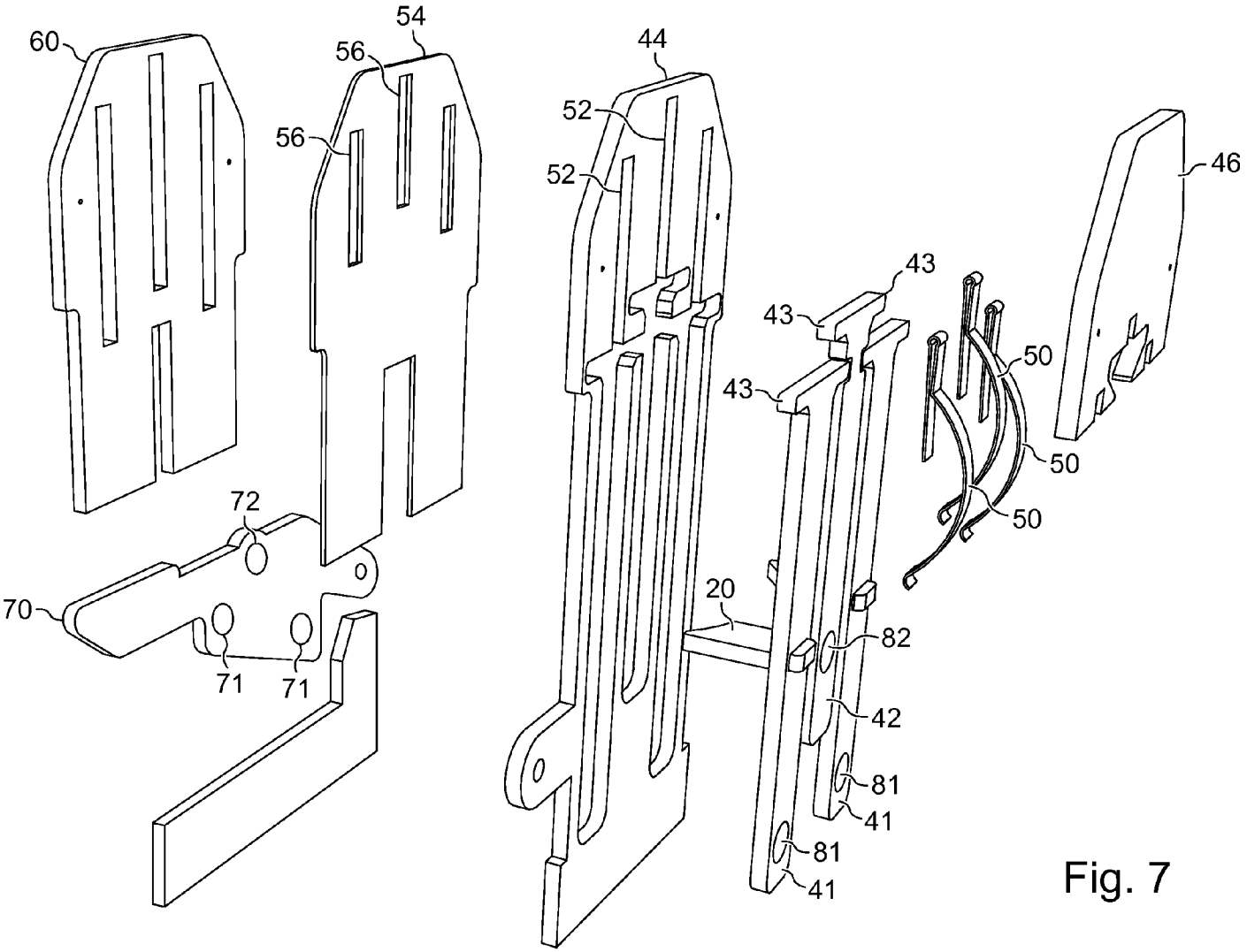
FIG. 7 is an exploded perspective view of the lid dispensing mechanism used in the configuration of FIG. 5.

FIGS. 5, 6, and 7 illustrate a preferred embodiment of the inventive device incorporating the features and concepts discussed above and configured for application in dispensing drink lids to persons for individual use.

FIG. 5 is a perspective view of a manual lid dispenser 30 configured for moveable placement and use on a horizontal working surface such as a tabletop or countertop. The dispenser 30 includes a lid chute 32 with vertical walls 33 defining a chute cavity 34 for holding and protecting a quantity of lids in a vertical stack (not shown) within the chute 32. A front wall is not shown, but may be provided of clear material to enable inspection and maintenance of lids placed within the chute 32. Preferably, the chute 32 includes a removable wall or top to enable placing lids in the chute 32. The specific design and construction and materials of the chute 32 is not critical. However, the walls 33 are preferably spaced and located to guide a stack of lids placed within the chute 32 into proper position onto the supports 20 as discussed below. Alternatively, the walls 33 or chute 32 may include other guide elements for the same function.

Four supports 20 extend through the walls 33 into the chute cavity 34 in an arrangement as illustrated in FIGS. 1 to 3. In FIG. 5, only the elements extended from the far wall 33 are visible, but identical elements are associated with the opposite chute wall. Similarly, grippers 24 extend from two opposing walls and between the associated supports 20. The supports 20 and grippers 24 extend through the walls to the operating elements outside the chute 32 and within dispenser side covers 35. The side covers 35 are not critical but only provide protective covering for the device operating elements.

The grippers 24 and supports 20 operate generally in the same fashion as discussed above, respecting FIGS. 1 to 4, to dispense lids from a lid stack within the chute 32. An inclined ramp 36 and lid presentation shelf 37 are located within or below the chute 32 and below the supports 20 and grippers 24 so that dispensed lids during operation will be moved by gravity to a convenient location for access by a user. The particular arrangement of the ramp 36 and shelf 37 are not critical.

FIG. 6*a* illustrates the dispenser of FIG. 5 with the side covers 35 removed to expose the operating elements of the dispenser. Each dispenser 30 has two sets of operating elements, located on opposing sides of the chute 32. Each set of operating elements provide movement to two supports 20 and one gripper 24 on one side of the chute 32. In FIG. 6*a*, one set 38 of operating elements is shown separated from the device for illustration purposes. Each set of operating elements is secured to a side of the chute 32.

In the operating condition shown in FIG. 6*a*, the dispenser 30 is ready to receive and retain a stack of lids in the manner discussed above respecting FIG. 1. The supports 20 are in the support condition and are each connected to, and extend horizontally from support arms 41. The chute 32 has a side wall opening associated with each support 20 to allow the supports to extend into the chute cavity 34 and allows their prescribed movement. The support arms 41 are generally vertical and pivotably held at their respective upper ends. By moving the lower ends of the support arms 41 outward, their respective supports 20 are withdrawn in the manner described respecting FIG. 3. Due to the orientation of each support arm 41 and associated support 20, the support 20 is moved slightly downward such that the resultant motion of the support is in a circular arc (about the support arm pivot point). This movement assists in separating the support 20 from the bottom lid and more cleanly releasing the lid for dispensing. The manner of moving the support arms lower ends is provided in more detail below. The support arms have two operating conditions: in the first, support condition, the support arm 41 is vertical and the respective support 20 is within the chute 32 and positioned to support lids as discussed respecting FIGS. 1 and 4; in the second (See FIG. 6*b*) the support arm 41 is angled outward and the respective support 20 is withdrawn from its supporting position.

Between each set of support arms 41 is located a gripper arm 42 that is configured similarly to the support arms 41. A gripper 24 is secured to each gripper arm 42 and extends therefrom into the chute cavity 34 through holes in the chute walls 33. The gripper arm 42 also has two operating conditions: in the first the gripper arm is angled outward (see FIG. 6*a*) and the associated gripper 24 is substantially withdrawn from a position to engage a lid stack in the chute 32; in the second the gripper arm 42 is vertical and the associated gripper 24 extends into the chute to engage a lid stack (see FIG. 2). In the same manner as the support arms 41, the movement of the gripper arm 42 follows a circular arc. From its first condition (gripper withdrawn) to its second condition, the gripper 24 moves both inwardly and slightly upward. This path ensures that until engaged with the lid stack, the gripper ledge 26 is below the perimeter of the lid that is adjacent (above) the bottom lid (see FIG. 2*b*) to ensure that the gripper ledge 26 does not disrupt the lids. The gripper 24 is substantially the same as that illustrated in FIGS. 1 to 3.

FIGS. 6*a* and 6*b* also illustrate the two positions of the dispenser operating lever 48. The operating lever 48 is shaped and positioned for manual access and operation by a user to dispense lids from the dispenser 30. The operating lever 48 is biased into a first position (FIG. 6*a*) by two springs 49 and can be moved through two conditions to operate and move the support arms 41 and gripper arms 42. The details of these operating are provided below.

FIG. 7 is an exploded perspective view of one set of the operating elements illustrated in FIGS. 6*a* and 6*b*. The construction of the two sets on the two opposing side of the dispenser are identical although mirror image arrangments. The support arms 41 and the gripper arm 42 each have a "T" shaped top end with horizontal fingers 43 extending to each side. The support arms 41 and gripper arm 42 are supported, vertically, by these fingers 43 within a frame 44. The frame 44 includes respective shelves 45 that receive and loosely support the arms. A capture plate 46 is secured to the outside of the frame 44 to retain the arms 41, 42 in the frame 44. The capture plate 46 covers only a portion of the fingers 43 and provides sufficient clearance to allow the arms 41, 42 to rotate outward about the contact between the arms 41, 42 and the shelves 43. This provides a means of pivotably securing the arms 41, 42.

To control the operation of the support arms 41 and gripper arms 42, opposing forces are provided on the two sides of each arm 41, 42. On one side of each arm, a first end of a flat leaf spring 50 bears on the arm surface. The second end of each spring 50 passes through a frame slot 52 to engage a spring plate 54. The second end of each spring 50 has a folded clip portion that is inserted into a respective spring plate slot 56 and is then pushed down to be rigidly secured to the spring plate 54. The capture plate 46, frame 44, spring plate 54 and a spacer plate 60 are each formed of plate sheet material and are secured, in stacked sandwiched fashion, against the outside of the chute 32 (FIG. 6*a*).

The thickness and placement of a spacer plate 60 provides a gap behind the frame 44 and below the spring plate 54 in which a lever arm 70 is pivotably secured. The spacer plate 60 also includes slots to accommodate the back side portions of the springs 50 extending beyond the spring plate 54. Slots in the spacer plate 60 and spring plate 54 also allow the gripper 24 to extend into the chute 32.

Each spring 50 biases its associated support arm 41 or gripper arm 42 toward the chute 32 to enable the supports 20 and grippers 24 to function. The inward travel of the support arms 41 is limited by portions of the spring plate 54 extending below the level of the shelves.

To bias and move the support arms 41 and gripper arms 42 outward, magnetic forces are employed. Each support arm 41 has an embedded support arm magnet 81 and each gripper arm 42 has an embedded gripper arm magnet 82. The lever arm 70 is pivotably secured to the dispenser 30 such that it may move, in the slot below the spacer plate 60, parallel to the frame 44 between two positions. In the first position, the lever arm 70 is most elevated (against a stop) as shown in FIG. 6*a* and FIG. 7. The lever arm has three embedded magnets. In the first position, a first lever arm magnet 72 is located to align with the gripper arm magnet 82. The lever arm also has support arm mating magnets 71 that, in the first position give no effect. In a second lever arm position, rotated downward, the supporting arm mating magnets 71 are aligned with the supporting arm magnets 81. The aligned mating magnets in respectively the lever arm 70 and support arm 41 or gripper arm 42 are coordinated to present to each other the same magnetic poles such as to create mutually repelling magnetic forces. The result of the first position is shown in FIG. 6*a* and result of the second position is shown in FIG. 6*b*. It is critical that magnets of sufficient power are selected such that, with the given separating space, the opposing force of the respective supporting arm or gripper arm spring 50 is overcome. The magnets are preferably embedded in holes preformed in the respective parts. Note that the gripper arms 42 are allowed to reach their second position (such that the grippers are engaged with the stack) before the support arms 41 are moved outward to their second position.

The lever arms 70 of the mechanisms on the two sides of the dispenser are coordinated and linked by the rigidly connected lever 48 such that the two mechanisms work in a simultaneous and coordinated fashion to operate all supports 20 and grippers 24. This simultaneous operation is critical to ensure certain separation of the bottom lid as shown in FIG. 3. The lever 48 and lever arms 70 function as a controller or actuator for the device. As described, movement of the lever arms 70 through a single continuous range of motion, controls and actuates the support arms 41 and gripper arms 42 to move the supports 20 and grippers 24 through all the conditions required to dispense a single lid. Return of the lever 48 and lever arms 70 through the opposite range of motion resets the dispenser to its original position, ready to dispense in the same manner another lid.

To enable this particular mechanism, the support arms 41 and gripper arms 42 extend substantially below the supports 20 and grippers 24 to allow space and geometry for placing the magnets and their associated supports. The function of the magnets, to provide outward biasing or force and movement to the support arms 41 and gripper arms 42, may alternatively be provided by other mechanisms and designs. For examples, mechanical springs or inclined mating parts or other devices might be used in alternative. For those purposes, the support arms 41 and gripper arms 42 may have other constructions, configurations or shapes. However, significant advantages of the magnetic mechanisms shown are at least: smooth and quiet operation, simplicity of component part manufacture and ease of assembly.

In the configuration described above and shown in the drawing figures, four support 20 are used to support a stack of lids. Together they comprise an effective horizontal support surface for a lid stack. This configuration allows simple operation of the support from two sides. However, their function may, alternatively, be carried out by two or more than four individual supports. In those cases, the mechanism for moving the supports would necessarily be changed from that described here. However, such alternative configurations would satisfy the intentions of the invention if their operation provides the same result. Similarly, more than two grippers 24 may be employed to accomplish the same function described here. In the various cases, the combined mechanisms used to carryout the described functions of controlling and dispensing a single lid may be considered a single dispensing operator system.

The above mechanism defines both a particular device for carrying out the invention and a method of dispensing lids from a vertical stack. The method may be carried out by operation of alternative mechanisms that provide the same functions as described above. In all cases, a vertical stack is supported evenly from below. The bottom lid is separated from the lids above it. The support below the bottom lid is removed to allow the bottom lid to fall away by gravity while the remaining lid stack is retained by supporting at least a portion of the lids in the stack by their edges.

While the above embodiments are described as stand-alone devices for placement on a working surface, the same concepts and mechanisms may be incorporated into existing structures. For example, the chute described above, or other stack container, may be located and supported within an incidental structure, such as a food service counter or "island" in a restaurant. In such a configuration, the operable mechanisms may be hidden from view behind a structure wall or within a counter or island cavity with an aperture to allow dispensed lids to pass therethrough. A user operated button, lever, or other actuator may then be used to manually, or remotely, operate the dispenser device. A remote button or lever may be linked to the dispenser electrically or by other means to control or activate a powered drive to actuate the dispenser. For this purpose, an electric motor, or pneumatic or hydraulic powered actuator may be connected to or part of the dispenser operators. Other methods or devices to employ the inventive dispensing device or methods are contemplated and any and all such that include the invention as claimed should be deemed within the scope of the invention.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A food container lid dispenser comprising:

multiple support surfaces, mutually coplanar and horizontal in a support condition;

multiple grippers arranged symmetrically about a vertical axis and movable alternatively towards and away from the vertical axis, each gripper configured to engage lid edges of a portion of a vertical lid stack located on the support surfaces without transmitting substantial force to the stack;

a moveable lid separator configured to be moved into a location between the two bottom-most lids in the lid stack; and a dispensing operator configured to cause the grippers to move toward the vertical axis to engage the lid stack and place the separator between the two bottom-most lids, and subsequently move the support surfaces away from the vertical axis to allow a bottom lid to fall from the lid stack; and wherein:

the dispensing operator further comprises multiple magnetic pairs, each pair arranged to mutually repel each other to force a respective gripper or support surface away from the vertical axis.

* * * * *